US005456359A

United States Patent [19]

Horn

[11] Patent Number: 5,456,359

[45] **Date of Patent: * Oct. 10, 1995**

[54] DEVICE FOR HOLDING CYLINDRICAL OBJECTS

[76] Inventor: Billy L. Horn, 1313 Greenbriar, Rapid City, S. Dak. 57701

[ * ] Notice: The portion of the term of this patent subsequent to May 31, 2011 has been disclaimed.

[21] Appl. No.: 232,369

[22] Filed: Apr. 25, 1994

Related U.S. Application Data

[63] Continuation-in-part of Ser. No. 959,117, Nov. 12, 1992, Pat. No. 5,316,143.

[51] Int. Cl.[6] ..... B65D 85/70

[52] U.S. Cl. ..... 206/378; 206/350; 206/443; 206/818; 211/70.6; 211/DIG. 1

[58] Field of Search ..... 206/350, 378, 206/818, 443; 211/70.6, DIG. 1; 335/285

[56] References Cited

U.S. PATENT DOCUMENTS

| | | | |
|---|---|---|---|
| 563,787 | 7/1896 | Moyer | 335/285 X |
| 2,565,625 | 8/1951 | Phelon | 335/285 |
| 2,958,019 | 10/1960 | Scholten et al. | 335/285 |
| 2,966,992 | 1/1961 | Dunkelberger et al. | 335/285 X |
| 3,095,525 | 6/1963 | Hansen | 335/285 |
| 3,405,377 | 10/1968 | Pierce | 335/285 |
| 4,497,412 | 2/1985 | LaBelle | 211/70.6 |
| 4,802,580 | 2/1989 | Andersen | 206/378 |
| 5,080,230 | 1/1992 | Winnard | 206/350 |
| 5,313,181 | 5/1994 | Negus | 335/285 |
| 5,316,143 | 5/1994 | Horn | 206/378 |
| 5,343,181 | 8/1994 | Negus | 206/350 |

FOREIGN PATENT DOCUMENTS

| | | | |
|---|---|---|---|
| 0006139 | of 1912 | United Kingdom | 335/285 |
| 0789632 | 1/1958 | United Kingdom | 335/285 |

*Primary Examiner*—Bryon P. Gehman

*Attorney, Agent, or Firm*—John R. Duncan; Frank D. Gilliam

[57] ABSTRACT

A holder for supporting magnetic cylindrical tools of varying diameter such as wrench sockets, drill bits, etc. in order. A member having a series of recesses having shapes corresponding to the tools to be held is backed by an elongated magnet. In one embodiment, the member is a non-magnetic material and the magnet is made up of a plurality of transverse magnetic regions, having alternately north and south poles on the surface toward the recesses, with the pole lines between adjacent north and south regions aligned with the centerline of the recesses. Preferably, a narrow non-magnetized region separates each pair of adjacent north and south pole regions. In a second embodiment, the member is formed from a magnetic a U-shaped sheet with the recesses formed in opposed sidewalls. The magnet is held between the sidewalls below the recesses and has two longitudinally arranged north and south poses at the surface toward the recesses, with the pole line running longitudinally along the center of the magnet. Preferably, a narrow non-magnetized region is interposed along the pole line between the north and south pole regions.

14 Claims, 2 Drawing Sheets

DEVICE FOR HOLDING CYLINDRICAL OBJECTS

CROSS-REFERENCE TO RELATED APPLICATIONS

This application is a continuation-in-part of my earlier filed U.S. patent application Ser. No. 07/959,117, filed Nov. 12, 1992, now U.S. Pat. No. 5,316,143.

BACKGROUND OF THE INVENTION

This invention relates in general to holders for cylindrical tools and the like and, more specifically, to a magnetic holder for sets of wrench sockets, drill bits and other cylindrical magnetic metal tools having uniformly changing diameters through the set.

A very wide variety of holders have been developed for maintaining sets of tools and the like in a desired order on a support means. Where the objects to be held in place are formed from a magnetic metal, magnets are often employed to hold the objects in the desired order on a support. Often, spaced magnets or strips of magnetic material are mounted on a vertical surface so that magnetic material objects placed thereagainst will be held in place. Typical such arrangements are described by Dunkelberger et al. in U.S. Pat. No. 2,966,992 and Case in U.S. Pat. No. 2,457,032. These holders, however, do not maintain the objects being held in any particular order and often the magnets have insufficient strength to hold the objects in place, especially where the holder is moved or bumped.

A number of different magnetic holders have been developed for holding wrench sockets on a holder in order of decreasing (or increasing) socket diameter. Bars with holes having diameters corresponding to the decreasing diameter of sockets in a set have been provided with magnets at the bottoms of the holes to hold sockets in the holes, as described by Pierce in U.S. Pat. No. 3,405,377. While useful where the holes extend downwardly or horizontally, the magnets often do not have sufficient strength to hold the sockets in place when the holder is moved or inverted since they contact only narrow end rims of the sockets.

In order to increase the magnetic holding strength, magnets have been arranged along slots in a knife blade holder to contact and attract both sides of a knife blade, as shown by Labelle in U.S. Pat. No. 4,497,412. While useful with knives of different lengths, but reasonably uniform blade thickness, this arrangement is not easily adaptable to objects of varying thickness or diameter.

Holders using a series of uniform spaced troughs with a relatively weak magnet behind the troughs to help hold objects in the troughs are disclosed by Moyer in U.S. Pat. No. 563.787 for holding writing pens. Magnetic forces are quite weak with the poles of the magnet at one end of the holder, so that magnetic strength decreases significantly toward the other end of the holder.

Many prior holders for sets of wrench sockets use an elongated magnet along which the sockets can be placed, such as those shown by Anderson in U.S. Pat. No. 4,802,580 and Miller in U.S. Pat. No. 4,591,817. These holders do not provide anything to maintain the sockets in the desirable regular pattern of decreasing (or increasing) diameter, and the magnets contact only a small part of the sockets so that the retaining strength is low, often permitting sockets to be inadvertently dislodged from the holder.

Thus, there is a continuing need for a holder for cylindrical objects of varying diameter, such as wrench sockets, drill bits and the like, which maximizes magnetic forces holding the objects in place and provides a configuration that assures that the objects will be held in a selected order by diameter.

SUMMARY OF THE INVENTION

The above-noted problems, and others, are overcome by a holder for cylindrical objects of varying diameter which basically comprises a series of transverse partially-cylindrical recesses that increase in diameter (or, looking from the opposite end, decrease in diameter) along the holder, with a magnet adjacent to the bottom of each recess to hold cylindrical magnetic objects, such as a wrench sockets, drill bits, threading taps or the like in place.

In one embodiment, the holder is made from a non-magnetic material in the form of a strip in which the recesses are formed. The magnet is arranged with alternate north and south pole areas at the surface adjacent to the recesses, with the interfaces between north and south poles aligned with the centers of the recesses to provide maximum magnetic holding power. Optimally, narrow non-magnetic areas are provided between adjacent north and south poles. The strip is preferably bounded by sidewalls and end walls that add rigidity and provide a channel in the side opposite the recesses for holding the magnet in place. Transverse apertures are preferably provided in the bottom of each recess so that the magnet can be positioned very close to an object in the recess, substantially in contact with the object.

In a second embodiment, a generally U-shaped channel of magnetic metal is provided, with upstanding side walls connected by a bridging bottom wall therebetween. The recesses are formed in the sidewalls. A magnet is provided along the bottom wall, positioned so that the exposed magnet surface is closely adjacent to, or substantially in contact with, an object positioned in a recess. The magnet preferably has two adjacent north and south poles on the upper and lower surfaces, divided longitudinally of the magnet. Optimally, the adjacent north and south poles are separated by a thin non-magnetic strip. This magnet orientation, in conjunction with the magnetic metal side walls, has been found to greatly increase and concentrate the magnetic forces holding a magnetic metal objects in the recesses.

Accordingly, it is an object of this invention to provide a new and improved holder for cylindrical metal objects such as wrench socket, drill bits, threading taps and the like of the sort that are stored in sets having regular increasing diameters from smallest to largest.

Another object of the invention is to maximize the magnetic attraction of magnetic metal objects to the holder while permitting easy and convenient removal and return of the objects.

A further object of the invention is to provide a holder which can be magnetically mounted on metal structures in a variety of orientations, stored in tool boxes and the like and moved without disengaging objects from the holder.

Yet another object of the invention is to provide a magnetic holder for holding cylindrical magnetic metal objects in spaced recesses wherein the magnetic attraction of the object to the holder is maximized.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
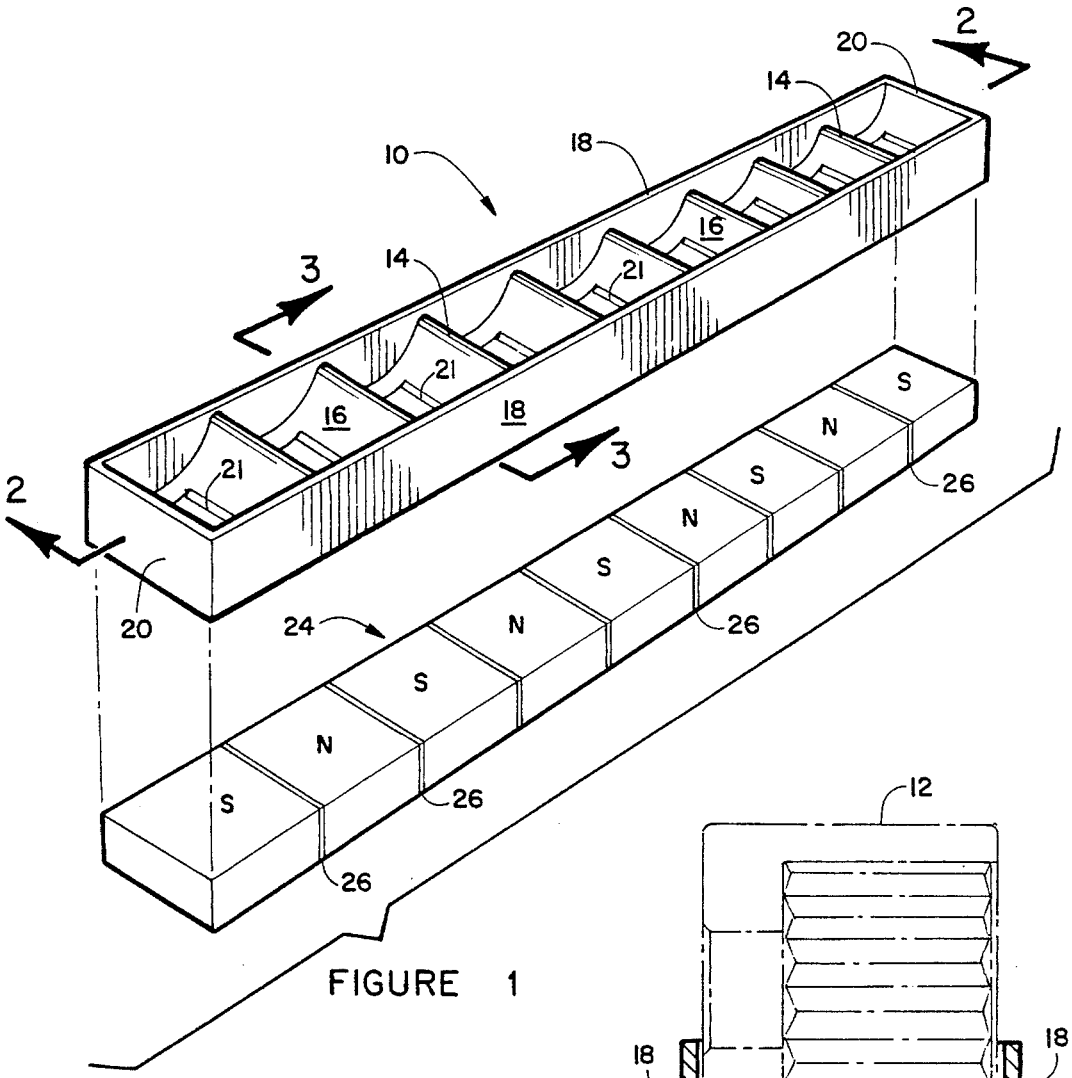
FIG. 1 is a schematic exploded perspective view of one embodiment of the cylindrical object holder of this invention.
Figure 3:
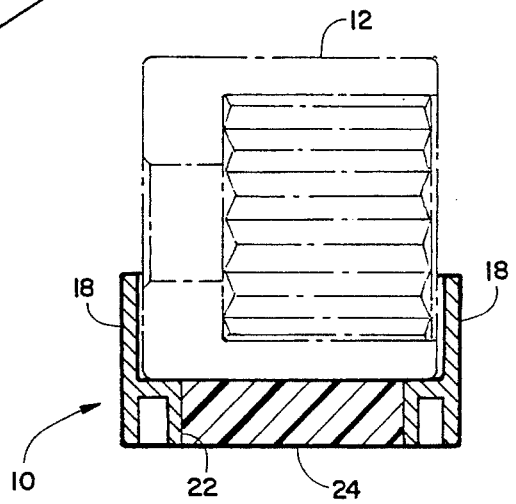
FIG. 3 is a section view taken on line 3—3 in FIG. 1.
Figure 2:
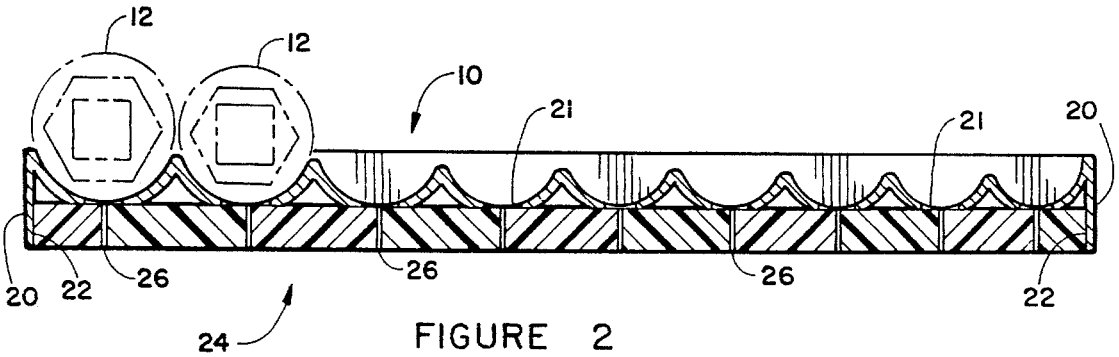
FIG. 2 is a section view taken on line 2—2 in FIG. 1.

Referring to FIGS. 1–3, there is seen a holder 10 adapted to hold a series of cylindrical objects 12, such as wrench sockets, drill bits, threading taps and the like, of increasing (or decreasing, depending on the point of view) diameter. For purposes of illustration, conventional wrench sockets are illustrated in FIGS. 2 and 3 as representative of objects 12.

Generally, holder 10 is rectangular in shape, although it could be trapezoidal where the objects 12 have regularly varying lengths, such as drill bits. In the embodiment shown, holder 10 includes a strip 14 formed in a series of partial-cylindrical recesses 16, side walls 18 and end walls 20. The distance between side walls 18 will be selected in accordance with the length of the objects to be stored. The distance between end walls 20, and the radius of recesses 16, will be determined in accordance with the diameters of the objects to be stored and the number of objects to be stored.

Holder 10 may be formed by any suitable method. Injection molding is preferred for simplicity and ease of manufacture. While any suitable non-magnetic material may be used for holder 10, a thermoplastic or thermosetting plastic such as polypropylene, styrene, acrylic, nylon or the like is preferred. The material may include colorants, fillers, reinforcements such as glass fibers, etc. as desired.

A channel 22 is provided within side walls 18 and end walls 20 at the base of holder 10 to receive and support a magnet 24. Magnet 24 may be held in place in any suitable manner, such as by a tight friction fit or by adhesive bonding using a conventional adhesive such as an epoxy, silicone or cyanoacrylate adhesive.

An elongated transverse aperture 21 is provided at the bottom of each recess so that the magnet upper surface will be closely spaced adjacent to an object in the recess, or ideally substantially in light contact with the object. As best seen in FIG. 2, the edges of apertures 21 are tapered to lie along the upper surface of magnet 24.

Magnet 24 has a series of discrete areas or regions with alternating north and south poles at the upper surface (the lower surface, of course, having the opposite pattern of poles). In the embodiment of FIGS. 1–3, pole lines 26 are located in a plane that includes the axis of the recess 16 (and, inherently, the axis of the object to be held in the recesses) and lies perpendicular to the length of holder 10. I have found that this focuses the strength of the magnet at the line of contact between the magnet and the object producing maximum holding power.

For best results with maximum magnetic attraction to the stored objects, a narrow non-magnetic region is interposed between each adjacent north and south poles at pole lines 26. For optimum results, this non-magnetic region should have a thickness of from about 0.020 to 0.100 inch. Where the cylindrical objects are small in diameter, so that the distance between succeeding pole lines is small, the non-magnetic region optimally will have a thickness toward the narrow end of the above range.

Figure 7:
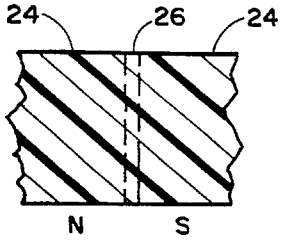
FIG. 7 is a sectional view taken across an interface between adjacent magnetic regions, as at 7—7 in FIG. 1.

Magnet 24 may be any suitable magnet material, including ceramic, metallic and flexible magnet materials. Preferably, magnet 24 is formed from a conventional flexible magnet of the sort having magnetizable barium ferrite particles dispersed in a rubbery matrix. Such materials are available from the Minnesota Mining and Manufacturing Company and RJF International Corporation. The alternate areas having north and south poles at the top surface may be formed in a sheet of flexible magnetic material by magnetizing strips of appropriate widths (the widths decreasing with decreasing recess diameters) along a web having a width corresponding to the length desired for magnet 24. The desirable very narrow non-magnetic regions between poles at each north-south pole interface are easily provided during the magnetizing process. Then the web is sliced transversely to provide a magnet having the elongated configuration shown. FIG. 7 shows a cross section corresponding generally to line 7—7 in FIG. 1 through an interface 26 between north and south magnetic regions in magnet 24 where a sheet of magnetizable material has been magnetized to form strips with alternating north and south poles on a surface and a thin non-magnetized region indicated by broken lines along interface 26. FIG. 7 shows a cross section corresponding generally to line 7—7 in FIG. 1 through an interface 26 between north and south magnetic regions in magnet 24 where a sheet of magnetizable material has been magnetized to form strips with alternating north and south poles on a surface and a thin non-magnetized region indicated by broken lines along interface 26. Alternately, a strip of flexible magnetic material having the same pole on each side could be cut along the pole lines 26 as shown, then alternate pieces could be turned over to provide the desired pattern. Such pieces could be adhesively bonded to for a unitary magnet 24. Thin strips of non-magnetized material can be placed between adjacent pieces to provide the desirable thin non-magnetized interfaces or the piece edges could be coated with a non-magnetized material to provide interface layers.

The lower surface of magnet 24 is exposed, so that holder 10 can be held to a magnetically attractable metal, such as a steel shelf, work bench, tool box or the like. Because of the strength of the magnets when used with pole lines 26 arranged as shown, the holder may be mounted vertically or even inverted without risk of involuntary separation of objects from the holder.

Figure 4:
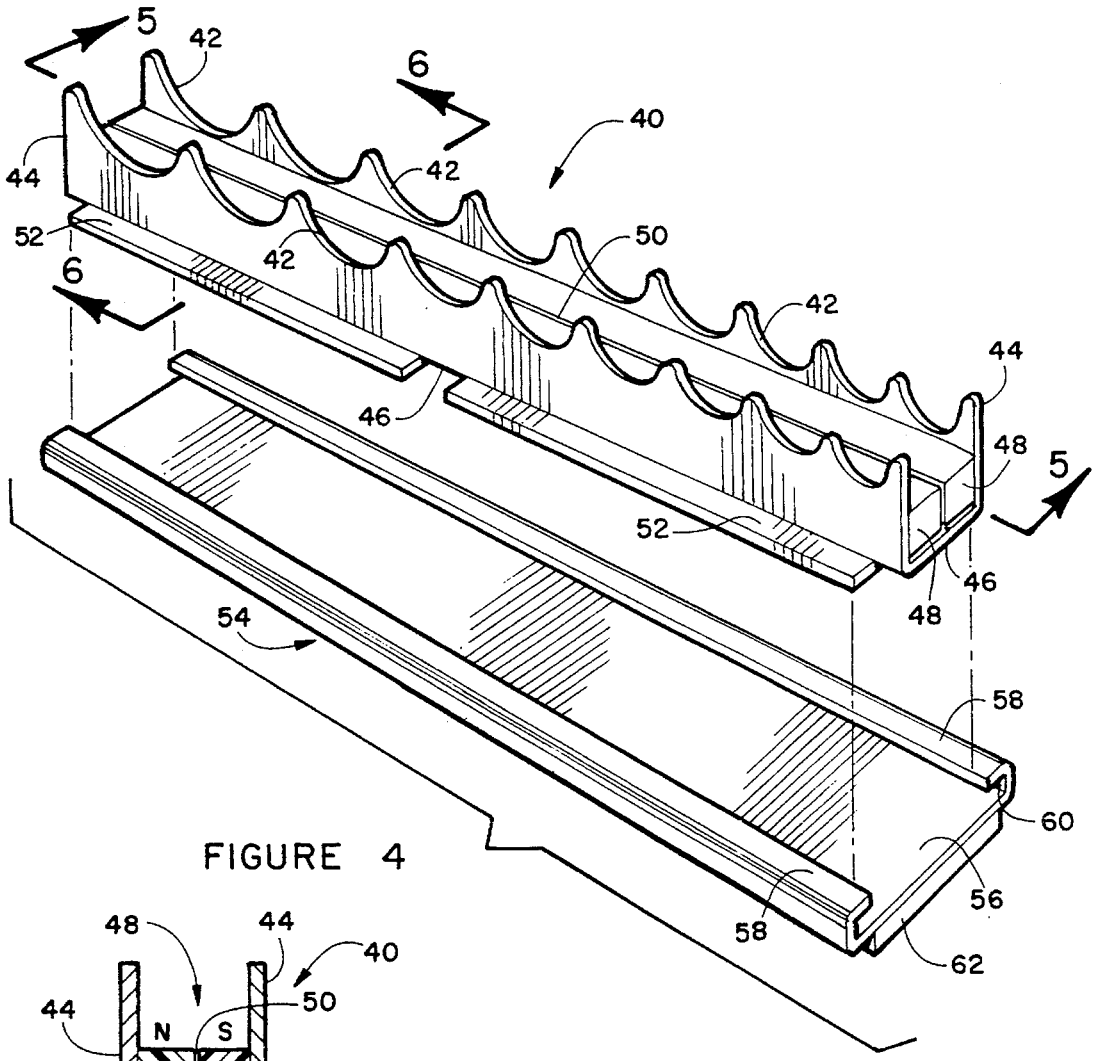
FIG. 4 is a schematic exploded perspective view of a second embodiment of the cylindrical object holder of this invention.
Figure 6:
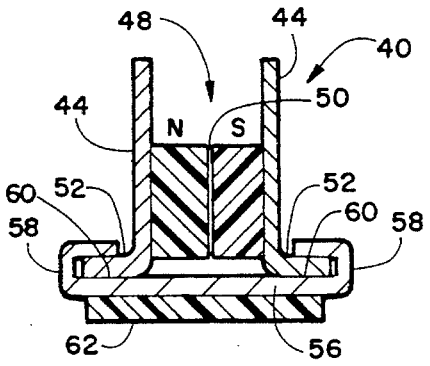
FIG. 6 is a section view taken on line 6—6 in FIG. 4.
Figure 5:
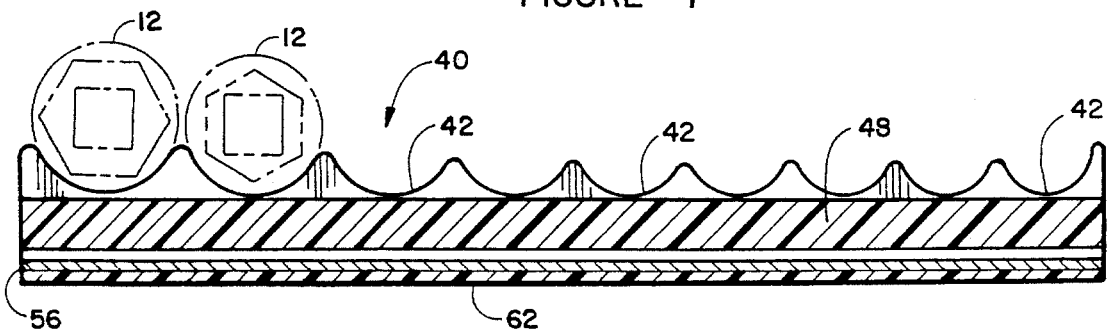
FIG. 5 is a section view taken on line 5—5 in FIG. 4.

A second embodiment of the holder of this invention is shown in FIGS. 4–6. Holder 40 here is in the form of a magnetizable metal channel with a generally U-shaped configuration. Recesses 42 having circular configurations corresponding to the cross section of the objects to be supported are formed across both sidewalls 44. A bridging wall 46 closes the bottom of holder 40.

An elongated magnet 48 is positioned in holder 40 with the upper surface of magnet 48 substantially aligned with, and tangent to, the bottom of each recess 42. Magnet 48 may be formed from any suitable magnet material, as detailed above and may be held in place in any suitable manner, such as by friction, adhesive bonding, screws through side wall 44, etc.

A pole line 50 extends longitudinally down the center of magnet 48, with one side having the north pole at the top and the other side have the south pole at the top, with a vertical pole line down the center. Preferably, a thin layer, typically having a thickness of from about 0.020 to 0.100 inch, is placed or formed between the north and south pole sides. In conjunction with the magnetizable metal sidewalls 44, the central pole line provides very high magnetic forces holding magnetic metal objects in recesses 42.

Portions of the base of holder 40 are cut and bent outwardly, forming flanges 52. Bridging wall portions 46 remain to maintain sidewalls 44 is position. If desired, holder 40 can be fastened to a wall, under a shelf, etc. by drilling holes in flanges 52 and inserting screws therethrough. However, it is preferred that a base 54 having a flat center 56 and folded edges 58 having a slot 60 therealong corresponding to flanges 52 be used. Base 54 may be made from any suitable non-magnetic material, such as aluminum or a rigid plastic. Flanges 52 can be slid into slot 60 and held in place by friction. If desired, countersunk screws, double-stick adhesive tape or the like could be used to hold base 54 to a wall, shelf or other surface while permitting holder 40 to be installed or removed as desired. In a preferred arrangement, a thin flexible magnet strip 62 is secured to the underside of base 54, such as by adhesive bonding. Then the assembly of holder 40 and base 54 can be easily attached and removed from any magnetic metal surface.

If desired, bridging wall 46 and flanges 54 may be omitted and the holder 40 could be an assembly of two magnetic metal sidewalls having recesses 42 and magnet 48, with this assembly pressed into a plastic channel tray, typically an extruded channel. In order to make picking up the tray without dislodging sockets or the like in place on the holder, outwardly extending flanges can be provided at the upper edge of the extruded channel or from the sides of the metal sidewalls.

The embodiment of FIGS. 4–6 is especially suitable for holding elongated cylindrical tools having varying diameters, such as drill bits, threading taps and the like, in addition to wrench sockets.

The holders of this invention significantly improve the visibility of socket heads or other tools when in place on the holder. The tools may be viewed both from the end and the side, making reading of size markings or other indicia convenient. The regular, sequential assembling of cylindrical tools by increasing (or decreasing) diameter makes selecting the correct size much easier. The ability to mount the holder in any position, including inverted under a shelf or the like makes access to the stored objects much more convenient.

Also, the filled holder can be carried in a pocket or tool box without any significant chance that objects will be dislodged.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A holder for magnetic metal cylinders of regularly varying diameters which comprises:

an elongated member having a plurality of closely spaced partial-cylindrical transverse recesses along a first surface;

said partial-cylindrical recesses increasing in diameter along at least a portion of said first surface;

an elongated magnet in engagement with said elongated member;

a surface of said magnet positioned adjacent to said recesses and having alternate transverse north and south pole regions; and the interface between adjacent surface north and south pole regions lying substantially in a plane including the axis of a recess and perpendicular to the length of said elongated member;

whereby a cylindrical object placed in a recess of corresponding diameter will be closely adjacent to said magnet along an interface between adjacent north and south pole regions.

2. The holder according to claim 1 wherein said member includes a continuous sheet of non-magnetic material in which said recesses are formed and further including an elongated transverse aperture at the bottom of each recess whereby said magnet is closely adjacent to the inner surface of said recess at said aperture.

3. The holder according to claim 2 wherein said continuous sheet of non-magnetic material is bounded by side walls along each long side and end walls along each end.

4. The holder according to claim 3 wherein said magnet is positioned in a channel formed by said side and end walls.

5. The holder according to claim 1 wherein said magnet comprises a material in which said alternate north and south pole regions are formed magnetically.

6. The holder according to claim 1 wherein said magnet is formed from a strip of magnetic material having north poles at one surface and south poles at the opposite surface which has been transversely cut and reassembled with alternate north and south poles on each surface.

7. A holder for magnetic metal cylinders of regularly varying diameters which comprises:

an elongated member comprising a continuous sheet of non-magnetic material at least partially formed into a plurality of closely spaced partial-cylindrical transverse recesses each having an inner and an outer surface;

said partial-cylindrical recesses regularly increasing in diameter;

an elongated magnet in engagement with said elongated member;

an elongated transverse aperture at the bottom of each recess whereby said magnet is closely adjacent to the inner surface of said recess at said aperture;

the magnet surface toward said recesses having alternate transverse north and south pole regions; and an interface between adjacent north and south pole regions lying substantially in a plane including the axis of a recess and perpendicular to the length of said elongated member;

whereby a cylindrical object placed in a recess of corresponding diameter will be substantially in contact with said magnet along said interface between adjacent north and south pole regions.

8. The holder according to claim 7 wherein said continuous sheet of non-magnetic material is bounded by side walls along each long side and end walls along each end.

9. The holder according to claim 8 wherein said magnet is positioned in a channel formed by said side and end walls.

10. A holder for magnetic metal cylinders of regularly varying diameters which comprises:

an elongated member having a generally U-shaped channel configuration including spaced sidewalls and a bridging wall therebetween;

said sidewalls having a plurality of closely spaced, complementary, partial-cylindrical transverse recesses;

said partial-cylindrical recesses regularly increasing in diameter along at least a portion of said elongated member;

an elongated magnet positioned on said bridging wall;

the surface of said magnet adjacent to said recesses having two adjacent north and south pole regions; and an interface between adjacent north and south pole regions lying substantially along the centerline of said elongated member.

11. The holder according to claim 10 wherein said magnet comprises a material in which said adjacent north and south poles are formed magnetically.

12. The holder according to claim 10 wherein said magnet is formed from a strip of magnetic material having north poles at one surface and south poles at the opposite surface which has been transversely cut and reassembled with adjacent north and south poles on each surface.

13. The holder according to claim 10 further including a base and means for securing said base to said elongated member opposite said recesses.

14. The holder according to claim 13 further including at least one additional magnet secured to said base for securing said holder to a magnetic metal structure.

* * * * *